US005311630A

United States Patent [19]

Nakamura et al.

[11] Patent Number: 5,311,630

[45] Date of Patent: May 17, 1994

[54] ROTARY ERASER

[75] Inventors: Shinsuke Nakamura; Satoshi Mochizuki, both of Tokyo, Japan

[73] Assignee: Midori Co., Ltd., Tokyo, Japan

[21] Appl. No.: 995,002

[22] Filed: Dec. 22, 1992

[30] Foreign Application Priority Data

Dec. 24, 1991 [JP] Japan ..... 3-111999

[51] Int. Cl.[5] ..... B43L 19/00

[52] U.S. Cl. ..... 15/3.53; 15/26

[58] Field of Search ..... 15/3.53, 26, 429, 430, 15/433

[56] References Cited

U.S. PATENT DOCUMENTS

| | | | |
|---|---|---|---|
| 846,287 | 3/1907 | Delle | 15/26 |
| 2,164,433 | 7/1939 | Smith | 15/429 |
| 4,817,226 | 4/1989 | Kuo | 15/3.53 |
| 5,015,111 | 5/1991 | Petterson | 15/429 X |
| 5,022,774 | 6/1991 | Kageyama et al. | 15/429 X |

FOREIGN PATENT DOCUMENTS

| | | | |
|---|---|---|---|
| 546700 | 7/1942 | United Kingdom | 15/26 |

*Primary Examiner*—Edward L. Roberts

*Attorney, Agent, or Firm*—Wenderoth, Lind & Ponack

[57] ABSTRACT

A rotary eraser has a simple structure, is extremely capable of erasing a letter or other printed material, and facilitates an adjustment of the position of the erase. The rotary eraser includes a cylindrical body, an eraser holder which holds a rod eraser and is rotated by pressing down the body, an outer cylinder which is rotatable together with the eraser holder, an energizing component which biases the eraser holder in a direction in which the rod eraser protrudes, and an eraser bearer by which the position of the eraser in the eraser holder can be changed when the outer cylinder is turned.

1 Claim, 3 Drawing Sheets

ROTARY ERASER

BACKGROUND OF THE INVENTION

1. Field of the Invention

This invention relates to a rotary eraser; in detail, a rotary eraser which is excellent in operability and can rapidly erase a letter or other printed matter.

2. Prior Art

Conventionally, various rotary erasers with which a letter or other printed matter is erased by manually rotating the rod eraser are offered. However, the conventional rotary erasers of such type have presented a problem that the mechanism is considerably complex, and adjusting the protrusion position of the rod eraser is difficult.

SUMMARY OF THE INVENTION

This invention is developed in consideration of the above-stated situation, and intends to offer a rotary eraser which is simple in construction, while being excellent in capability of erasing a letter or other printed matter, and with which adjustment of the protrusion position of the rod eraser can easily be made.

The rotary eraser of this invention is provided with:

a cylindrical body 4;

an eraser holder 7 by which a rod eraser 20 rotated by pressing down the body 4 is held so that it can be slid;

an outer cylinder 8 which is rotated together with the eraser holder 7;

an energizing component 10 which energizes the eraser holder in the direction of protrusion; and an eraser catcher 16 which changes the position of the eraser 20 in the eraser holder 7 when the outer cylinder 8 is turned.

Thus, with this configuration, a rotary eraser can be obtained that is simple in construction, while being excellent in capability of erasing a letter or other written matter on the paper P, and with which adjustment of the protrusion position of the rod eraser 20 can easily be made.

DETAILED DESCRIPTION OF THE INVENTION

The rotary eraser of this invention provides:

a cylindrical body on the inner periphery of which a spiral groove is formed;

an eraser holder consisting of a flange located in the body with the protrusions formed on the outer periphery engaged with the spiral groove and an eraser holding cylinder which is approximately cylindrical, extending from the flange to a location outside the body, and has a slot extending in the lengthwise direction, holding the rod eraser inside it so that the eraser can be slid, and which incorporates an eraser bearer on the side of the flange that has engaging protrusions protruded outward from the slot;

a cylindrical outer cylinder which is supported rotatably by the body, having radially arranged teeth on the upper end that are contacted with the bottom surface of the flange of the eraser holder, and having a spiral groove inside it that engages with the engaging protrusions of the eraser bearer, and which is protruded from the body while it surrounds the outer periphery of the eraser holding cylinder;

a cap plugging up the top opening of the body; and an energizing component which is provided between the cap and the flange of the eraser holder located in the body to energize the eraser holding cylinder in the direction of protrusion. The operation of the rotary eraser described above will be described hereinafter.

The body of this rotary eraser is held by hand and the rod eraser is directed downward to be contacted with a paper on which a letter or other matter to be erased is written. Then, the body is pressed down, and the pressing down force applied to the body produces a torque in the eraser holder through the protrusions of the flange that are engaged with the spiral groove in the body, resulting in the rod eraser held by the eraser holder also being rotated, thus, the letter or other written matter on the paper can rapidly be erased.

When the body is released from the pressing down force, the energizing force of the energizing component 10 forces the eraser holder to be reversed to return to the initial position.

Adjustment of the state of protrusion of the rod eraser from the eraser holder is made by manually turning the outer cylinder. With the body held by one hand, turning the outer cylinder by the other hand changes the relative position of the eraser bearer having the engaging protrusions engaged with the spiral groove in the inner periphery of the outer cylinder to the outer cylinder and the eraser holder, which adjusts the protrusion state of the rod eraser from the eraser holder.

As described above, the rotary eraser 1 of the present embodiment is excellent in capability of erasing a letter or other written matter on the paper P while it is simple in construction, and in addition, the protrusion position of the rod eraser 20 can be adjusted with extreme ease.

The following is a detailed description of the preferred embodiment of the rotary eraser related to this invention.

Figure 1:
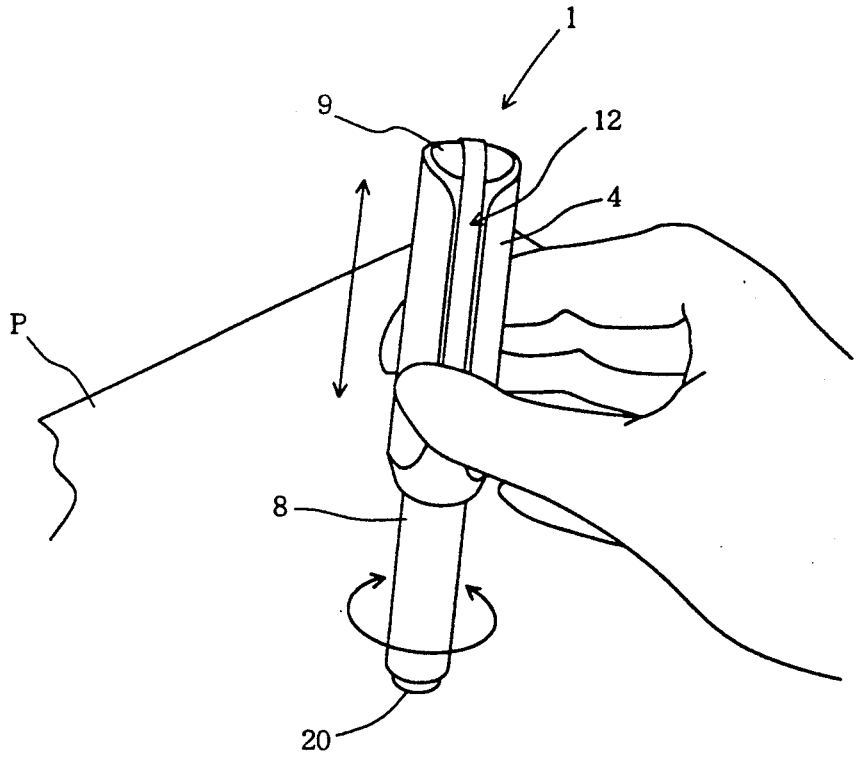
FIG. 1 is a bird's-eye view of the operation of the rotary eraser which is an embodiment of this invention.
Figure 2:
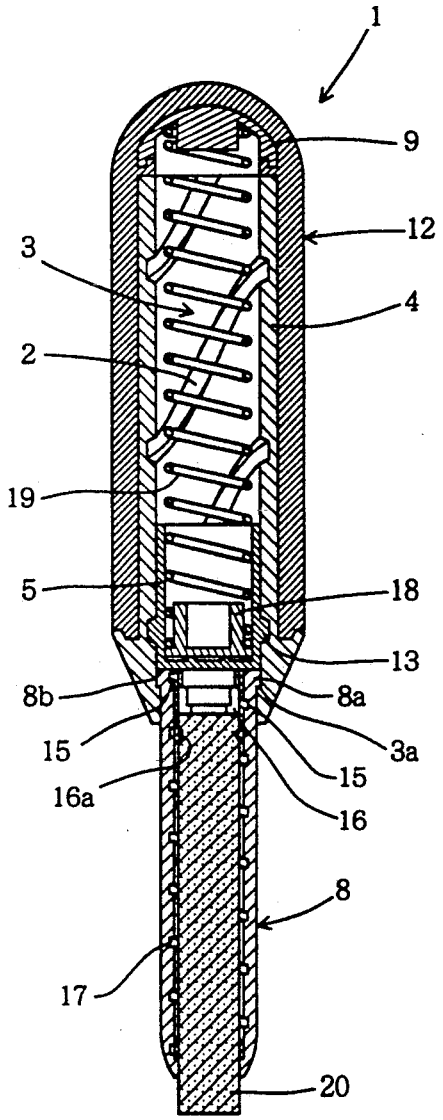
FIG. 2 is a sectional view of the rotary eraser which is an embodiment of this invention.
Figure 3:
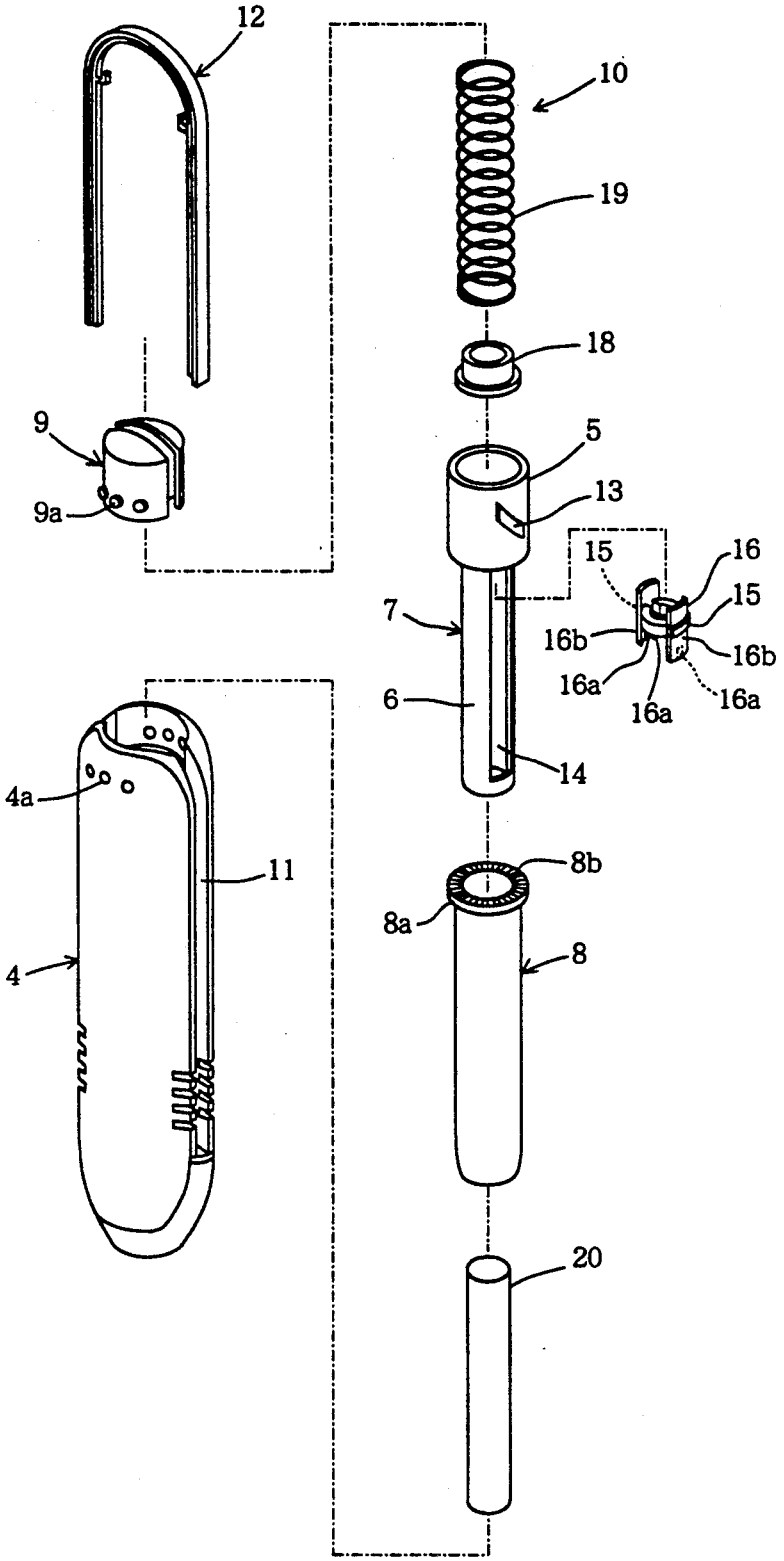
FIG. 3 is an explosion view of the rotary eraser which is an embodiment of this invention.

The rotary eraser as shown in FIGS. 1 to 3 is provided with:

a cylindrical body 4 having a through-hole 3 on the inner periphery of which a spiral groove 2 with a long pitch is formed;

an eraser holder 7 consisting of a flange 5 and an eraser holding cylinder 6;

a cylindrical outer cylinder 8;

a cap 9 plugging up the top opening of the body 4;

an energizing component 10 which is provided between the cap 9 and the flange 5 of the eraser holder 7 located in the body 4, and which energizes the eraser holding cylinder 6 in the direction of protrusion;

and a reverse-U-shaped cover 12 made of a material such as plastic or rubber that is fitted into the elongated groove 11 formed on the outer periphery of the body 4 along the lengthwise direction.

The through-hole 3 in the body 4 is provided with a smaller-diameter bore 3*a* in the lower end portion that has a diameter smaller than that of the through-hole 3, thus forming a shoulder.

The flange 5 of the eraser holder 7 is cylindrical, and the outer periphery has more than one protrusion 13 which engages with a spiral groove 2 formed on the inner periphery of the body 4.

The eraser holding cylinder 6 of the eraser holder 7 is approximately cylindrical, being formed as an integral part of the flange 5, and having a slot 14 along the lengthwise direction. The eraser holding cylinder 6 incorporates an eraser bearer 16 on the side of the flange 5 that has engaging protrusions 15 which are protruded outward from the slot 14.

At the lower end of the eraser bearer 16, a pair of small protrusions 16*b* and 16*b* are formed, and on the inner surfaces of the small protrusions 16*b* and 16*b* and the bottom surface of the eraser bearer, more than one edged projections 16*a* are provided that are to be contacted with the periphery of the top end portion of the rod eraser 20 to bite it.

The eraser bearer 16 holds the rod eraser 20 inside it so that the eraser 20 can be slid, while the lower portion of the eraser 20 protrudes downward from the lower end of the eraser bearer 16.

The outer cylinder 8 is loaded in the through-hole 3 in the body 4 while it surrounds the outer periphery of the eraser holding cylinder 6, and it is supported rotatably by the body 4 with the top flange 8*a* being contacted with the shoulder formed by the smaller-diameter bore 3*a* to be confined in the through-hole 3. The end of the top flange 8*a* of the outer cylinder 8 is provided with radially arranged teeth 8*b* which are to be contacted with the bottom surface of the flange 5 of the eraser holder 7. On the inner periphery of the outer cylinder 8, a short-pitch spiral groove 17 which engages with the engaging protrusions 15 of the eraser bearer 16 is provided along the lengthwise direction.

The energizing component 10 consists of a spring catcher 18 provided in the upper portion of the eraser holder 7 and a coil spring 19 provided between the spring catcher 18 and the inside of the cap 9, thus always energizing the eraser holding cylinder 6 in the direction of protrusion.

The cap 9 has small protrusions 9*a* on the outer periphery that are fitted into the small holes 4*a* provided in the body 4, thus being connected integrally with the body 4 to plug up the top opening of the body 4.

The operation of the rotary eraser 1 will be described hereinafter.

As shown in FIG. 1, the body 4 of the rotary eraser 1 is held by hand and the rod eraser 20 is directed downward to be contacted with a paper P on which a letter or other matter to be erased is written. Then, the body is pressed down.

Then, as shown with the arrows in FIG. 1, the pressing down force applied to the body 4 produces a torque in the eraser holder 7 through the protrusions 13 of the flange 5 that are engaged with the spiral groove 2 in the body 4, resulting in the rod eraser 20 held by the eraser holder 7 also being rotated, thus, the letter or other written matter on the paper P can rapidly be erased.

The torque in the eraser holder 7 is transmitted to the outer cylinder 8 through the radially arranged teeth 8*b* provided on the upper end of the outer cylinder 8 to be contacted with the bottom surface of the flange 5 of the eraser holder 7, thus, the outer cylinder 8 is also rotated together with the eraser holder 7.

When the body 4 is released from the pressing down force, the energizing force of the energizing component 10 forces the eraser holder 7 to be reversed to return to the initial position. The energizing component thus serves as a restoring force component.

Adjustment of the state of protrusion of the rod eraser 20 from the eraser holder 7 is made by manually turning the outer cylinder 8. With the body 4 held by one hand, turning the outer cylinder 8 by the other hand changes the relative position of the eraser bearer 16 having the engaging protrusions 15 engaged with the spiral groove 17 in the inner periphery of the outer cylinder 8 to the outer cylinder 8 and the eraser holder 7, which adjusts the protrusion state of the rod eraser 20 from the eraser holder 7.

As described above, the rotary eraser 1 of the present embodiment is excellent in its capability of erasing a letter or other written matter on the paper P while it is simple in construction, and in addition, the protrusion position of the rod eraser 20 can be adjusted with extreme ease.

This invention is not limited to the above-stated embodiment, and permits various variants to be embodied within the scope of the claim.

With this invention described in detail heretofore, the configuration stated above can offer a rotary eraser which is excellent in the capability of erasing a letter or other matter written on the paper while it is simple in construction, and with which the protrusion position of the rod eraser can be adjusted extremely easily.

What is claimed is:

1. A rotary eraser comprising:

a cylindrical body having a top opening, a bottom opening, and an inner periphery at which a spiral groove is formed;

an eraser holder including a flange located in said cylindrical body and having an outer periphery, a plurality of protrusions extending from the outer periphery of said flange into said spiral groove, and an eraser holding cylinder which is approximately cylindrical and extends axially from the flange beyond the bottom opening of said body, said eraser holding cylinder having a slot extending axially therealong;

an eraser bearer in the eraser holding cylinder adjacent to the flange, the eraser bearer having engaging protrusions which protrude outward from the slot;

a rod-shaped eraser located inside the eraser holder;

an outer cylinder supported rotatably by the body, said outer cylinder having an upper end upon which are radially arranged teeth that contact a bottom surface of the flange of the eraser holder, and an internal spiral groove that receives the engaging protrusions of said eraser bearer, and said outer cylinder protruding from said body and surrounding said eraser holding cylinder;

a cap plugging up the top opening of said body; and a restoring force component which is provided between the cap and said flange of the eraser holder located in said body, said restoring force component exerting a biasing force opposing an externally applied downward force generated by a user on said rod-shaped eraser via said body and restoring the rotary eraser to a resting position upon cessation of the externally applied downward force.

* * * * *